US005440321A

United States Patent [19]

Hine, Jr.

[11] Patent Number: 5,440,321

[45] Date of Patent: Aug. 8, 1995

[54] CURRENCY OPERATED MODULAR DISPLAY DEVICE AND METHOD

[75] Inventor: Edward K. Hine, Jr., Louisville, Colo.

[73] Assignee: HS Industries, Inc., Louisville, Colo.

[21] Appl. No.: 184,755

[22] Filed: Jan. 21, 1994

Related U.S. Application Data

[63] Continuation of Ser. No. 883,528, May 15, 1992, abandoned.

[51] Int. Cl.[6] ..... G09G 1/00

[52] U.S. Cl. ..... 345/1; 40/124

[58] Field of Search ..... 40/124, 124.4, 489, 40/611; 194/217, 218; 312/216; 340/815.4; 345/1

[56] References Cited

U.S. PATENT DOCUMENTS

| | | | |
|---|---|---|---|
| 530,756 | 12/1894 | Evans et al. . | |
| 532,111 | 1/1895 | Streator | 40/611 |
| 641,971 | 3/1900 | Kelsey | 312/35 |
| 991,984 | 5/1911 | Hendren . | |
| 1,017,563 | 2/1912 | Lain et al. | 40/611 |
| 1,403,599 | 1/1922 | Goudeau | 312/97 |
| 1,416,267 | 5/1922 | Closson | 40/611 |
| 1,461,613 | 7/1923 | Gilbert | 312/35 |
| 1,809,378 | 6/1931 | Eschenbach | 40/438 |
| 2,003,542 | 6/1935 | Johnston | 40/618 |
| 2,117,045 | 5/1938 | Warner | 40/407 |
| 2,865,698 | 12/1958 | Smith | 312/138.1 |
| 4,490,932 | 1/1985 | McIntire | 40/124 |
| 4,809,378 | 11/1984 | Eschenbach | 40/438 |

*Primary Examiner*—Curtis Kuntz
*Assistant Examiner*—Minsun Oh
*Attorney, Agent, or Firm*—Harold A. Burdick

[57] ABSTRACT

A currency operated display device and method are disclosed, the device being in the nature of a public bulletin board and having a mounting structure, a plurality of modules attached to the mounting structure each with at least one normally closed and secured display area access, and a centralized user interface for user selection of display area, duration of material display and receipt of currency. A default display area is provided in each module behind the user display area for material display when the user display area is not in use. The device is configured so that all operations, including maintenance, are undertaken from the front of the device.

27 Claims, 13 Drawing Sheets

Fig_1
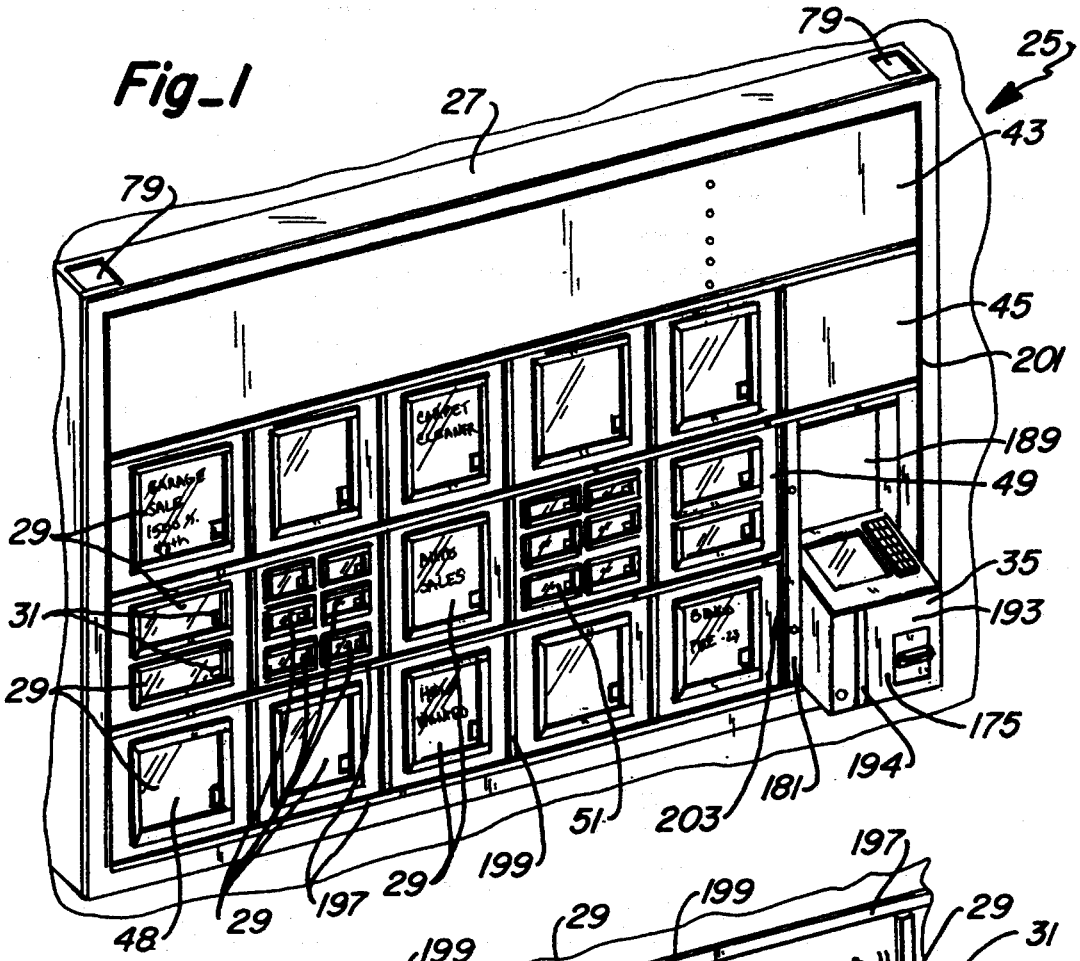
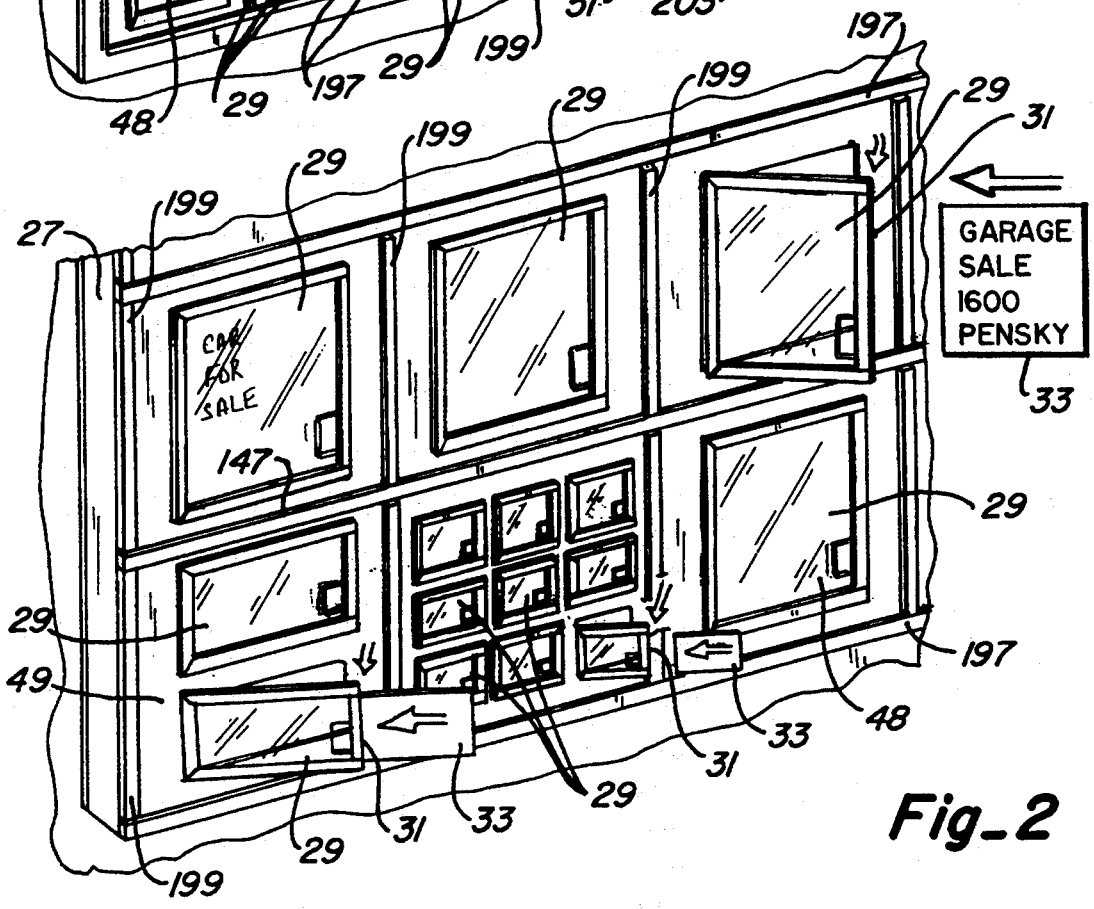
Fig_2

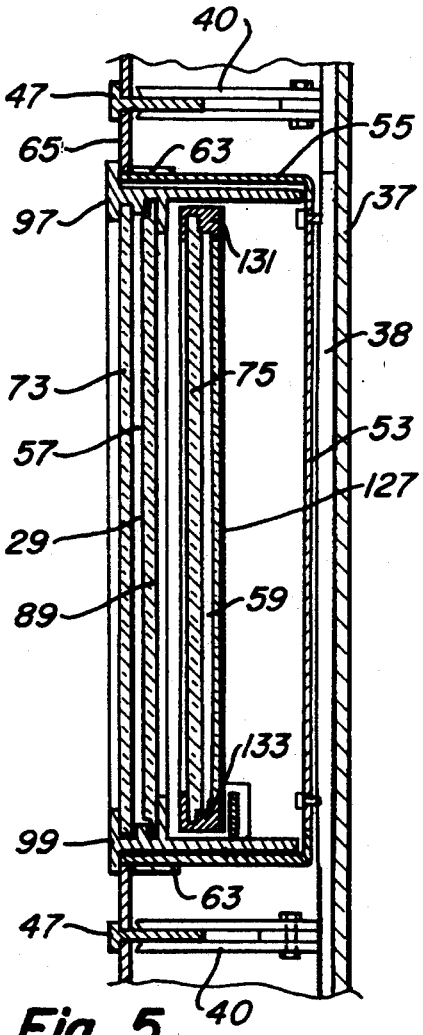
Fig_5
Fig_7
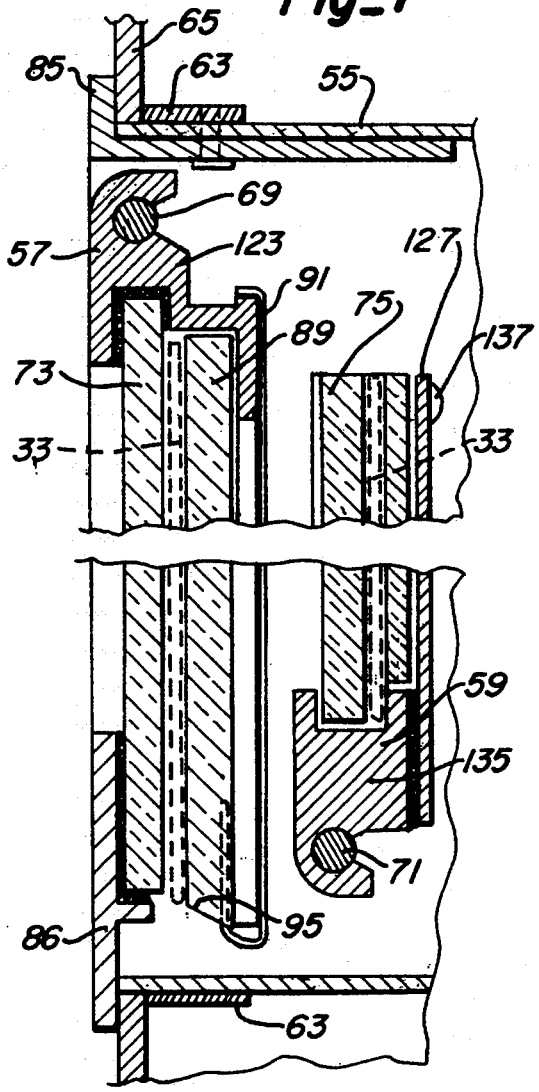
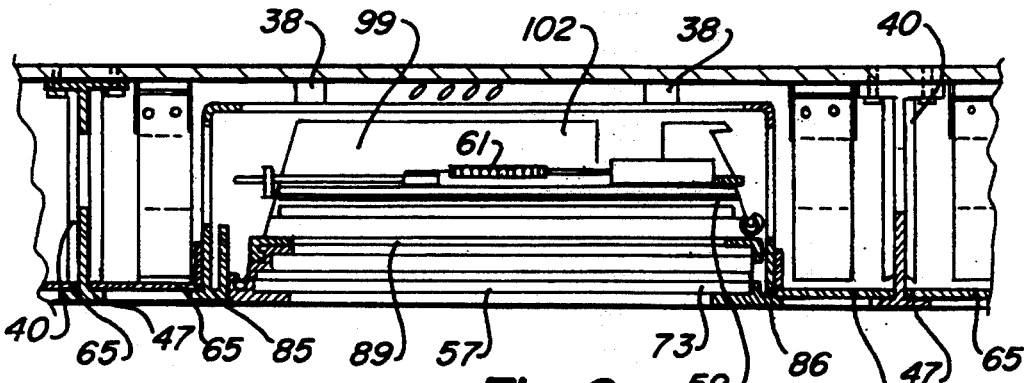
Fig_6

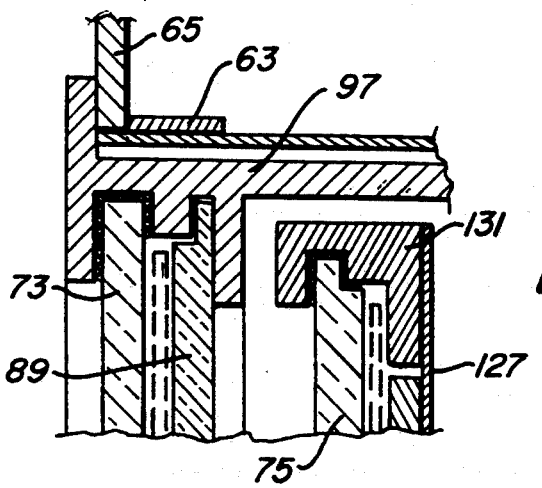
Fig_8
Fig_9
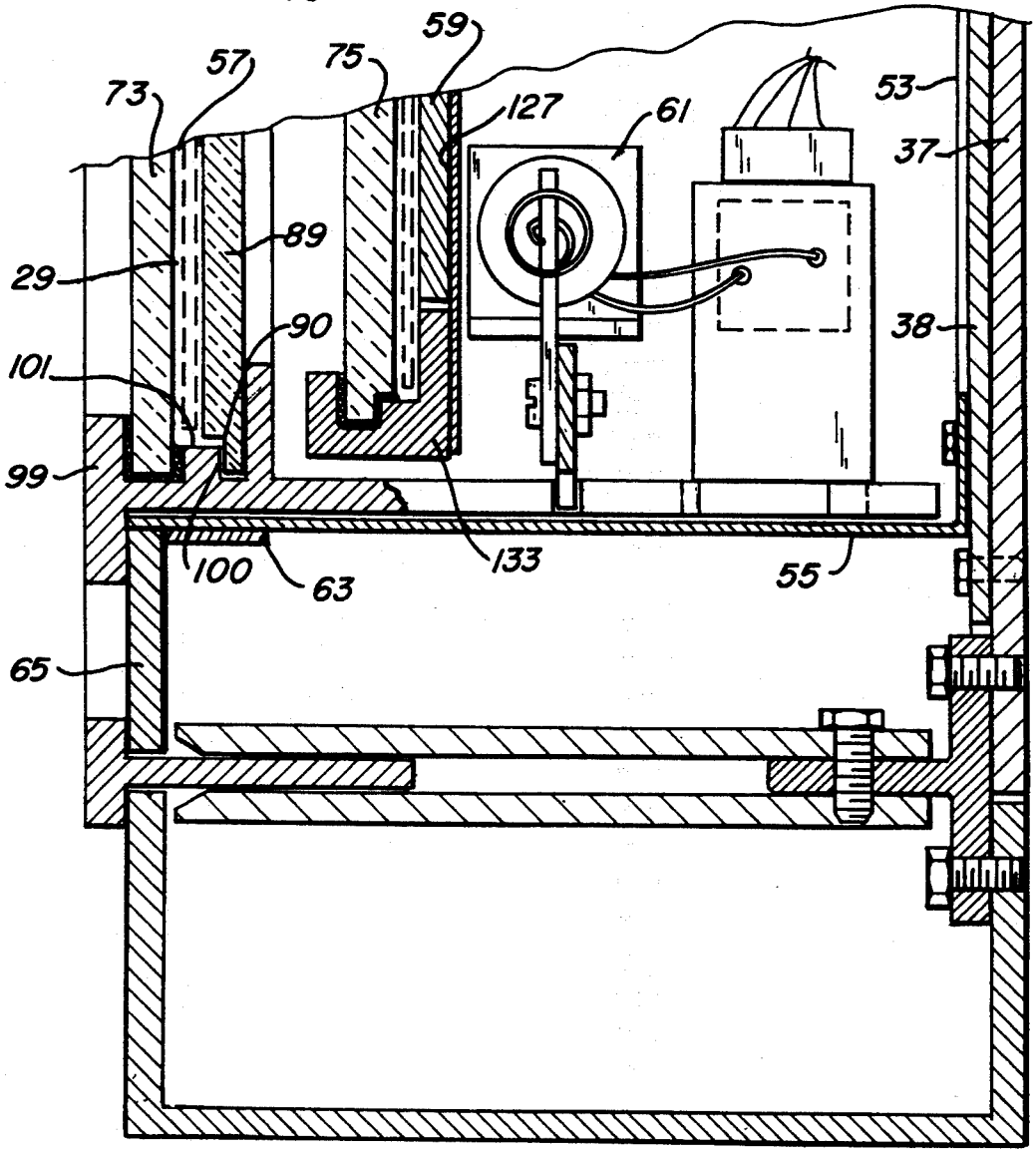

CURRENCY OPERATED MODULAR DISPLAY DEVICE AND METHOD

This is a application continuation of application Ser. No. 07/883,528, filed May 15, 1992, now abandoned.

FIELD OF THE INVENTION

This invention relates to display devices and methods, and, more particularly, relates to such devices and methods for printed matter.

BACKGROUND OF THE INVENTION

Various advertising or message boards, devices and/or signs have been heretofore suggested and/or utilized which offer interchangeability of content of the board or sign (see, for example, U.S. Pat. Nos 1,017,563, 1,416,267, 2,003,542, 532,111, 530,756, 1,809,378 and 2,117,045). In addition, various coin or key operated devices have been heretofore suggested and/or utilized for vending various goods and/or for storage of goods (see U.S. Pat. Nos. 991,984, 1,461,613, 1,403,599,641,971 and 2,865,698).

While such heretofore known means for display or storage of various materials have been useful, a need for community-type bulletin boards has arisen which has typically been addressed by placement of such boards in public facilities such as grocery stores, civic buildings recreation centers and the like where any member of the public may post notices (such as sale notices, lost pet notices, for hire notices and the like), or by indiscriminate posting of bills on street posts, kiosks and the like by members of the public.

Such public postings and public bulletin boards have posed problems, however, due to unsightliness, excessive litter, the need for maintenance of quality, timeliness and positioning of such notices, and use by some for long term commercial purposes. Therefore, public bulletin boards are often disdained by both members of the public (those who may wish to post a notice as well as those who might read it) and those in whose facility such a board may be located.

Improvements directed toward facilitating use of such places for posting notices by community members while providing an attractive and easily maintainable display thereof would be desirable.

SUMMARY OF THE INVENTION

This invention provides a user operated, currency activated display device for displaying material, such as printed matter or the like, selected by the user, and method therefor. The device includes a user display area (preferably a plurality thereof) having a normally closed and secured user access, and a user interface for centralized control of currency collection, user selection of display area, opening of the selected user access, device maintenance, and other user and/or maintenance functions.

The device is configured to be mounted, for example on a wall, is low profile, and entirely used and maintained from the front of the device. A default display area is provided behind each user display area for display of selected material (such as longer term commercial postings or the like) so that when a user display area is not in use the available display space is not wasted.

The device is modular in design for ease of maintenance, installation and selective configuration and/or reconfiguration, with each module having one or more display areas and associated user accesses housed therein.

It is therefor an object of this invention to provide and improved display device for use by members of the general public and method.

It is another object of this invention to provide a device for public postings which is easily maintained, attractive, and yet conservative of space.

It is another object of this invention to provide a currency activated display device and method for display of user selected materials.

It is still another object of this invention to provide a user operated, currency activated display device in the nature of a public bulletin board.

It is yet another object of this invention to provide a user operated, currency activated display device for displaying material selected by the user, the device including a display area having a normally closed and secured access for selective receipt thereat of the material for display, and a centralized control interface for, responsive to deposit of the currency by the user, opening the user access of the display area for placement by the user of the material therein.

It is another object of this invention to provide a currency activated display device for operation by any of a plurality of users to display material selected by the user activating the device, the device including a plurality of display units each having a normally closed and secured user access for receipt thereat of the material for display, means for holding the display units, and a control interface for, responsive to deposit of the currency and selection of one of the display units by the user, opening the user access of the selected one of the display units for placement by the user of the material therein.

It is still another object of this invention to provide a method for displaying user selected material in a currency activated device, the method including the steps of deposit by the user of selected currency in the device, opening by the device of a normally closed and secured display area access after the currency is deposited, placement by the user of the material into the display area, and closing of the access whereupon the access is again secured.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a perspective view of the device of this invention;

FIG. 2 is a perspective view of a portion of the device of FIG. 1;

FIG. 5 is a sectional view taken through section lines 5—5 of FIG. 3;

FIG. 6 is a sectional view taken through section lines 6—6 of FIG. 3;

FIG. 7 is a sectional view taken through section lines 7—7 of FIG. 3;

FIG. 8 is a sectional view taken through section lines 8—8 of FIG. 3;

FIG. 9 is a sectional view taken through section lines 9—9 of FIG. 3;

DESCRIPTION OF THE INVENTION

Figure 3:
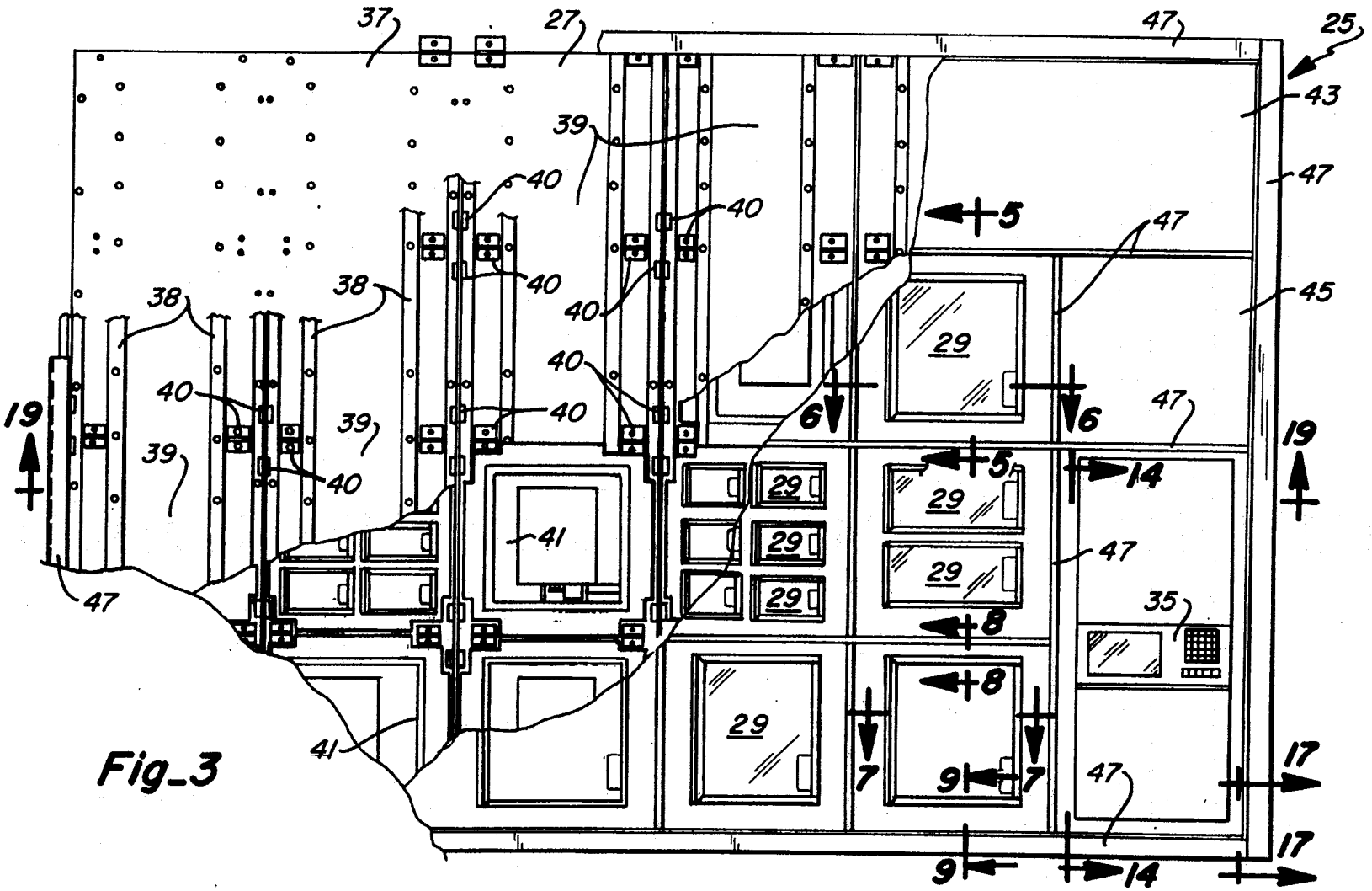
FIG. 3 is a front view of the device of FIG. 1 with portions cut away.

A currency operated, modular display device 25 in accord with this invention is illustrated in FIGS. 1 through 3. The device includes mounting frame 27, a plurality of user display areas 29 each having a user access 31 for receipt and display thereat of material (printed matter) 33, and control interface 35.

Frame 27 is configure to be mounted on a wall or stand, for example by bolting thereof through back panel 37 attached to the outer framework channels, and provides major structural support for the overall device. Module attachment bars 38 are attached to back panel 37 for attachment of components and to provide space between components and back panel 37 through which wiring may be run. Frame 27 is constructed to define a plurality of substantially identically sized modular bays 39, generally defined by the position of a plurality of spaced stop pairs 40, for receipt thereat of other components such as display area housing modules 41 and interface 35. As shown in FIGS. 1 and 3, device 25 contains 4 rows and 6 columns for a total of 24 bays, it being understood that other configurations could be utilized, depending on space availability and usage of bay space (as discussed below).

Graphic cover panels 43 and 45 include the headliner panel which runs along the entire uppermost part of the device and the upper customer panel which covers the modular bay above interface control 35, respectively. These panels cover whatever happens to be in the related modular bays (electronics, the computer, or the like) and provide space for displaying information for the public and the user/customer. The panels may be made of any suitable material, for example a three layer construction of a rigid aluminum back panel, a paper or thin plastic panel containing the graphic and text message, and a front panel made of clear plastic.

The graphic cover panels are held in place in frame 27 by frame stops 40 or the like attached to the frame and from the front by interlocking frame trim 47, the graphic cover panels resting on the lower frame trim piece when installed. To install a graphic cover panel the appropriate frame trim pieces are first partially inserted (as described in more detail hereinbelow), the panel is inserted from the side on top of the lower frame trim piece and then the combination of the trim and panel is pushed toward the back of the unit until correctly positioned.

Figure 4:
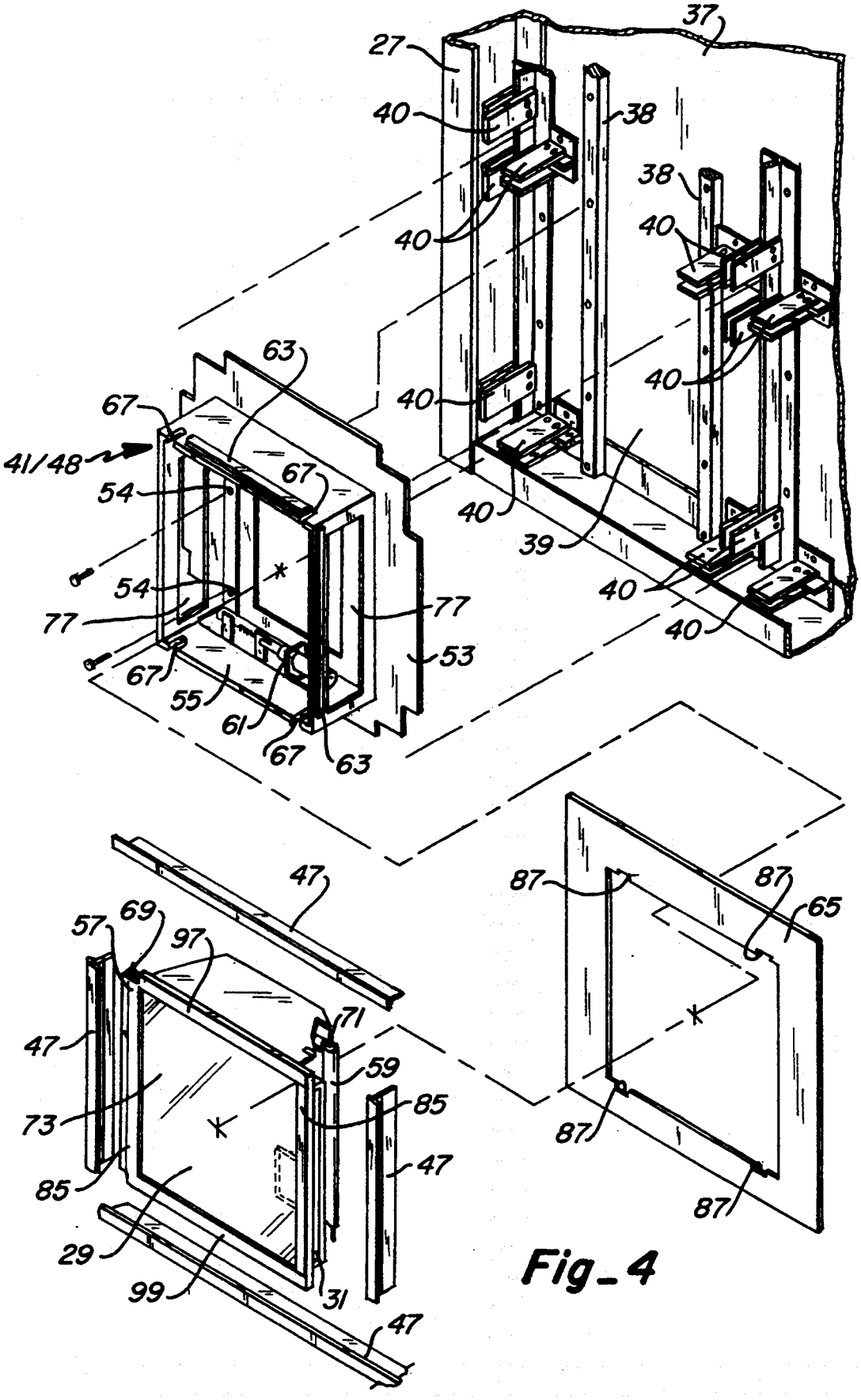
FIG. 4 is an exploded view of one of the display modules of the device in relation to the mounting structure thereof.
Figure 10:
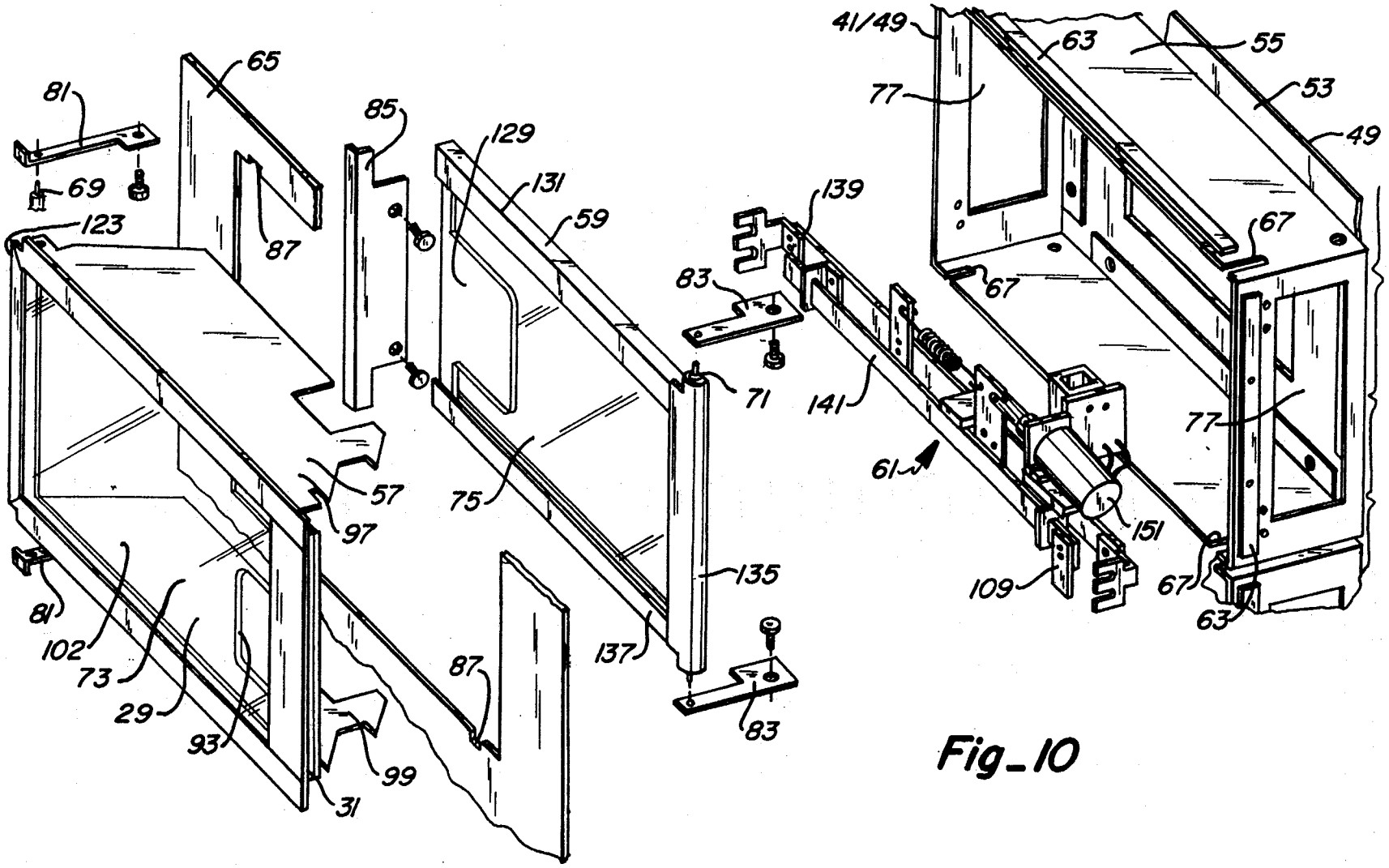
FIG. 10 is an exploded view of one of the modules particularly illustrating the user and default display accesses thereof.
Figure 12:
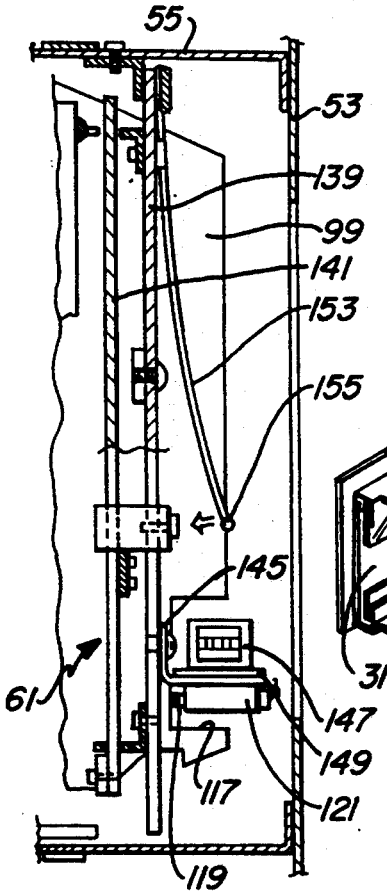
FIG. 12 is a sectional view taken through section lines 12—12 of FIG. 11.
Figure 11:
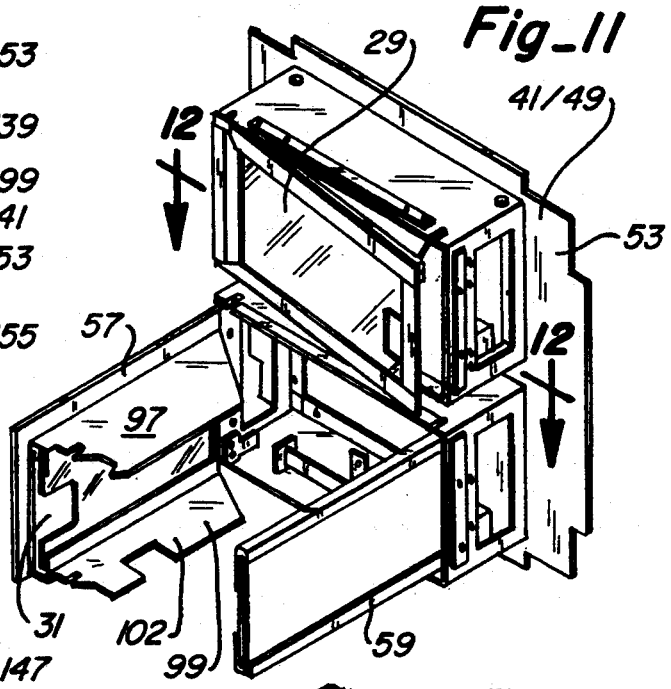
FIG. 11 is a perspective view of a second type of display module of the device.
Figure 13:
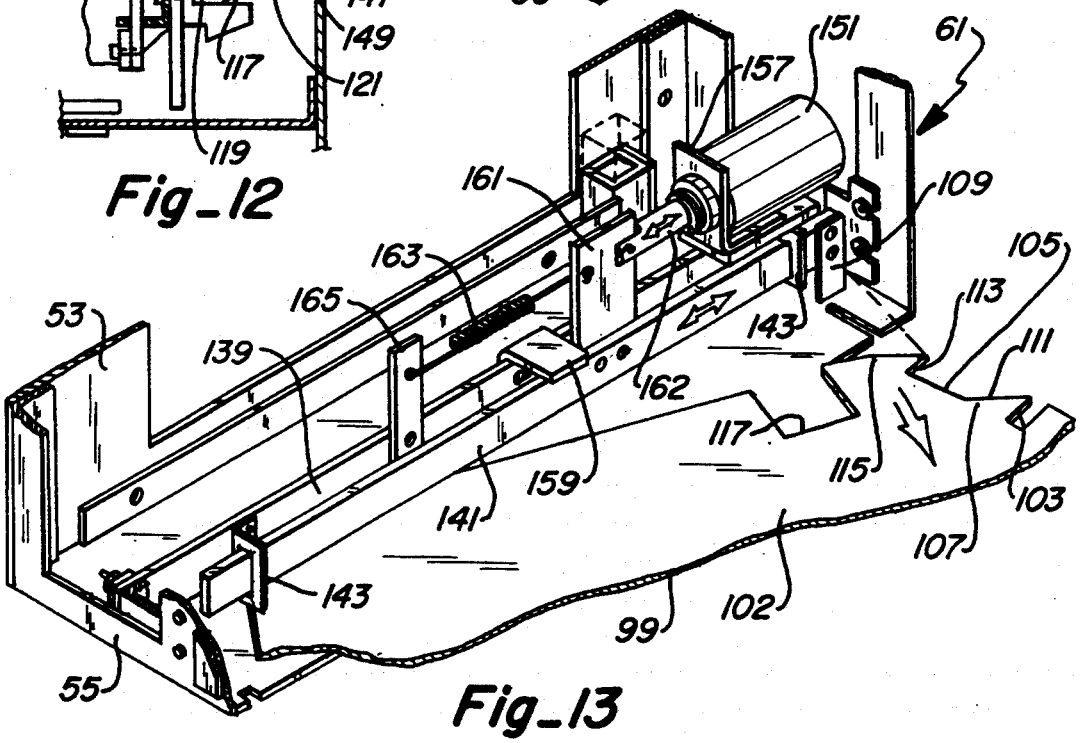
FIG. 13 is a perspective view of the access latch and switch mechanism of the device.

Turning now to FIGS. 4 through 13, substantially similarly sized display area modules 41 may be designed to accommodate one or more display areas, for example, module 48 (as shown in FIG. 4 having one display area per module for $8\frac{1}{2}'' \times 11''$ customer paper), module 49 (as shown in FIG. 11 having two display areas per module each for $5\frac{1}{2}'' \times 8\frac{1}{2}''$ customer paper), and module 51 (shown in FIG. 1 and having six display areas per module for $3'' \times 5''$ customer paper). It is possible to create other modules of different configurations using the same basic design.

Each module 41 includes rigid back plate 53 having holes 54 (four in this case) to bolt the module to attachment bars 38. Each back plate 53 has one or more cutouts in the back to cut weight and to allow passage of wiring into the channel formed by the back plate, frame back and module attachment bars.

Back plates 53 have rectangular notches cut at all four corners in order to clear stops 40 in the corners of each modular bay 39. The size of the back plate is such that it just fits into the modular bay (with a small tolerance allowance to prevent a force fit). Case 55 is attached to the back plate to thus form a display area housing (a more unitary construction of these two parts could of course be utilized). Case 55 provides the structural support for user display and default display area assemblies 57 and 59, respectively, and latch release assembly 61.

Ease case 55 has four bars 63 attached near the front edge of each side. These bars accurately position cover plate 65 and prevent it from moving toward the back of the unit, and are offset from the front of the case by a distance which approximately equals the thickness of cover plate 65 to form a flush surface between the front of the case and the installed cover plate. The case has four hinge slots 67 for user display and default display area assembly hinges 69 and 71, respectively. The default display hinge slots are recessed farther into the box to allow the default assembly to sit behind the user display assembly.

Holes/taps for attaching case 55 to plate 53 are not centered vertically but sit just a little higher than center to position the box a little above center. This is to offset gravity as it effects installing the module. By slightly offsetting the case upward on the back plate the case ends up being visually centered in the bay in relation to frame trim 47. Also, the hinge slots pairs are slightly offset horizontally (i.e., not directly above and below one another) to make display area windows (main 73 and default 75) sit square with each other.

Cutouts 77 through the left and right walls of case 55 cut the weight of the case and allow for hot air circulation out of the case and thus, in combination with frame holes 79 (at all four frame channel corners, as shown in FIG. 1), good internal air circulation throughout the entire device. Additionally, cutouts 77 allow mechanical access by maintenance personnel to access latch release assembly 61 from either side in the event of any electrical or mechanical malfunction inside the case which prevents access opening.

Each case contains a number of pem nuts (threaded inserts for screws or bolts) to make it possible to install and remove any or all of the internal contents of the case without having to first remove cover plate 65. For example, pem nuts on the top and bottom walls of case 55 are used to lock main and default hinge keeper pairs 81 and 83, respectively, (see FIG. 10) in place to thus easily and accurately position the user and default display assemblies in the fore/aft directions. Similarly, pem nuts are used to hold latch release assembly 61 in place.

Cover plates 65 cover the space between cases 55 and between the cases and frame trim 47. When installed, the cover plate is held in place between case bars 63 and window 73 by trim piece 85 and 86, and between stops 40 and frame trim 47. Each cover plate is gravity compensated in that the cutout is not exactly centered vertically in the plate but sits slightly low. Each cutout (one or more) in cover plate 65 includes four notches 87 along the inside edge of the cutout to provide clearance for the removal and installation of user display assembly hinge 69.

User display assembly 57 having display area 29 thereat includes fixed clear panel 73 (for example of tempered glass) defining the main viewing area, and in combination with removable clear panel 89 (preferably plastic), defines user access 31 (i.e., the paper path). Removal and resecurement of panel 89 (slidable on notch 90) is facilitated by selectively releasable retainer 91.

Panel 89 has finger notch 93 to allow gripping of paper during insertion and removal. The access side edge of panel 89 is beveled into the paper path to make it easier to get paper started into the path. Small rectangular notches are cut into the upper and lower access side corners to accept end 95 of retainer 91 thereat.

Trim wings 97 and 99 are made from an aluminum extrusion and serve a variety of functions. They provide visual cover trim over the edges of the case walls and the junction of the case wall edges and the cover plate inside edges when the assembly is closed. The several channels and surfaces needed to provide for structural assembly of panels 73 and 89 to thus form a smooth, unobstructed paper path are formed in wings 97 and 99. Panel 73 is glued in its channel, and panel 89 is slidably received at notch 90 on shoulder 100. In this manner a smooth, unobstructed path surface 101 (one that will not catch paper sliding into the path) is achieved (as shown in FIG. 9).

Wing portion 102 of trim wing 99 includes notches, or catches, 103 and 105 forming latch face 107 which provides the interface with the latch release assembly 61. Notch 103 engages tip 109 when in the fully closed and secured position of access 31. Notch 105 has a first incline edge 111 which is in effect an inclined plane approximately superimposed on the radius of the curve whose center point is the hinge pivot point. The first inclined edge pushes spring loaded tip 109 out of the way as assembly 57 is pushed closed until the tip drops into notch 103.

Customer stop 113 engages tip 109 after a user has made the relevant selections and deposited currency into the device, opening access 31 but preventing opening more than about 1". Second incline edge 115 acts in the same manner as first incline edge 111 to push tip 109 out of the way where assembly 57 is being closed after being open all the way by maintenance personnel. Switch notch 117 provides clearance for, and engages tip 119 of, switch 121 mounted on latch release assembly 61.

Hinge trim piece 123 is glued to panel 73 and has hinge rod 69 glued into it, and, like the trim wings, has a pair of panel channels to receive panels 73 and 89. Hinge rod 69 is preferably made of stainless steel to provide adequate structural strength in the upper and lower tip areas. When installed, the hinge rod tips are held in place in the left/right plane by slots 67 in case 55 and in the fore/aft plane by the hole in hinge keepers 81 once the hinge keepers are attached to the case.

Hinge keepers 81 provide the means by which assembly 57 is positioned and attached to case 55. In addition they provide a small trim piece (to visually cover the case wall and cover plate edges) in the corners (upper and lower) which cannot be made part of the trim wings (for pivoting clearance). Hinge rod 69, hinge keepers 81 and case slots 67 in combination provide for installation and maintenance convenience in that only the bottom keeper bolt and hinge keeper need to be removed to remove assembly 57.

Trim piece 85 screws into the left wall of case 55 and provides visual coverage of the case wall and cover plate edges. Trim piece 86 is glued to the surface of panel 73.

Default display area assembly 59 has many design features in common with assembly 57 and is designed to sit directly behind assembly 57 for display of a default message or ad when a user display area is not in use. Assembly 59 pivots in the opposite direction from assembly 57. Assembly 59 is slightly smaller vertically than assembly 57 in order to allow trim wings 97 and 99 to clear assembly 59 as assembly 57 pivots.

Removable clear panel 75 (made, for example, of plastic) and back panel 127 define the vertical walls of the paper path. Finger notch 129 is provided for ease of paper insertion and removal. Upper and lower trim pieces 131 and 133 are glued to back panel 127 and mate with panel 75 forming the top and bottom of the paper path while defining a visual border around the paper inserted therein.

Hinge trim 135 is glued to back panel 127, defines the end of the paper path and supports hinge rod 71 glued therein. Hinge keepers 83 function similarly to hinge keepers 81. Bumper 137, a small piece of foam rubber or other similar material, provides a resilient jam fit between assemblies 57, 59 and 61 which prevents undesirable rattling between the parts. A space available flag can be attached to the front of panel 75 to indicate to a user that the display area is available for use even though there is a visible default display.

Latch release assembly 61 (one per display area whether large or small) includes fixed beam 139 attached to case 55 and movable beam 141 slidable in guides 143 attached to beam 139. Switch mounting bracket 145 is attached to the back of fixed beam 139 for support of switch 121, wire connector 147, and solder board 149. Solder board 149 makes electrical connection with solenoid switch 151 and switch 121. Wire connector 147 faces upward and is located in an area which makes it easy to connect or disconnect the wiring plug from the front of the window.

Window spring 153 is attached at one end of fixed beam 139. The spring wire extends along the lower back of the fixed beam in such a way that all but spring tip 155 clears wing 99 as it travels under the fixed beam. As wing 99 is moved to its closed position, spring tip 155 engages wing 99 and rides along the back edge of the wing applying forward pressure thereto.

Solenoid mounting bracket 157 attached to fixed beam 139 orients solenoid 151 above the fixed beam with the retractable end thereof extending parallel to the fixed beam. Spring stop 159 attached to fixed beam 139 stops beam 141 (at attachment 161) and thus tip 109 from moving any farther to the left. Solenoid/spring attachment 161 is attached to movable beam 141 and extends vertically for attachment to the end of solenoid throw arm 162. Solenoid spring 163 is attached between fixed bracket 165 attached to beam 139 and attachment 161.

When power is applied to solenoid 151, solenoid/-spring attachment 161 causes movable beam 141 and thus tip 109 to move and spring 163 to tighten. When power is released spring 163 causes solenoid/spring attachment 161, and solenoid throw arm 162 (and thus the movable beam and tip) to return to normal position.

In operation, to open user display assembly 57 to the customer open position (about 1"), power is applied to solenoid 151 releasing tip 109 from wing latch face notch 103 and spring 153 starts pushing open assembly 57. When the electronics/computer sense that switch 121 has tripped (by release of switch tip 119 of switch 121 due to movement of wing portion 102), power is immediately cut from the solenoid thus causing tip 109 to move back to its normal position in time to engage customer stop 113 on latch face 107.

To open assembly 57 fully for access to default display assembly 59 or maintenance (either from the fully closed or customer open positions), power is applied to solenoid 151 for a sufficient period so that customer stop 113 clears tip 109.

Figure 14:
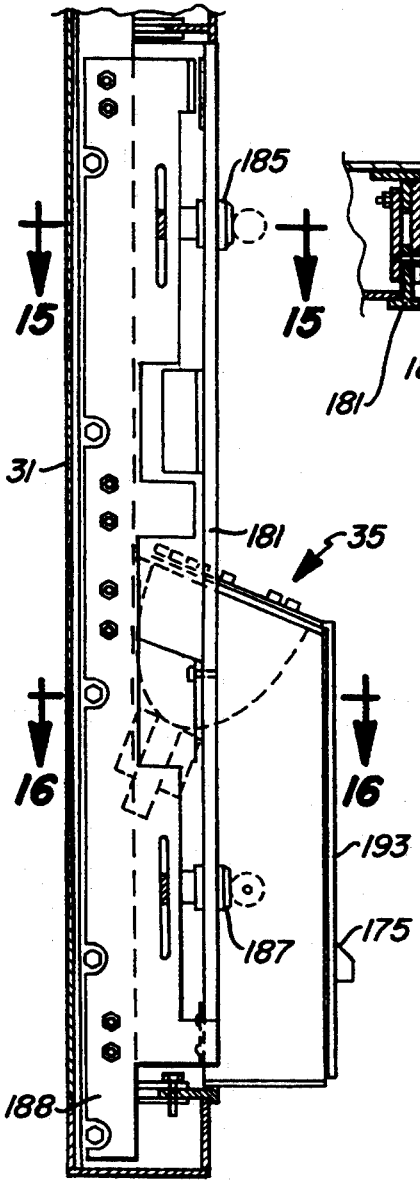
FIG. 14 is a sectional view taken through section lines 14—14 of FIG. 3.
Figure 15:
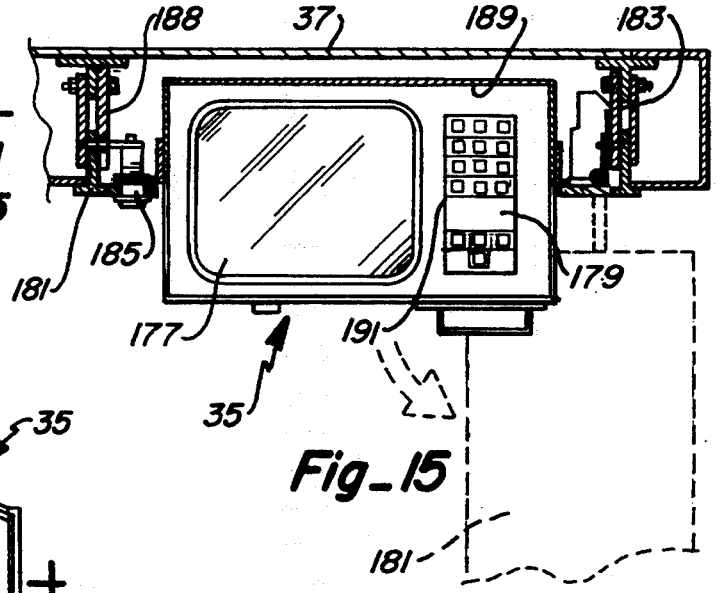
FIG. 15 is a sectional view taken through section lines 15—15 of FIG. 14.
Figure 16:
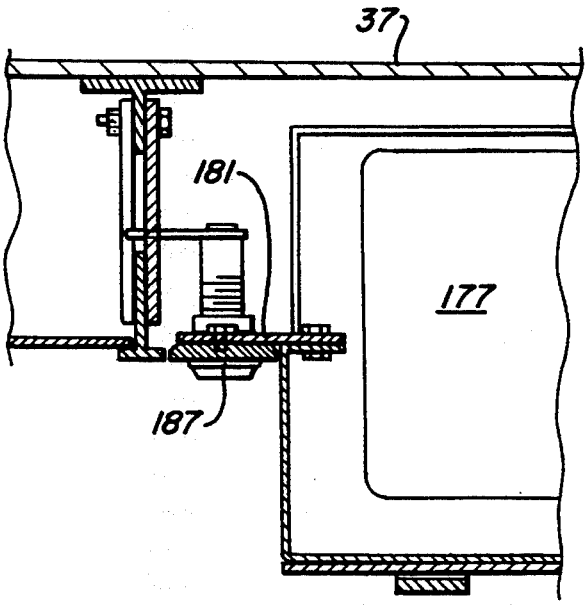
FIG. 16 is a sectional view taken through section lines 16—16 of FIG. 14.
Figure 17:
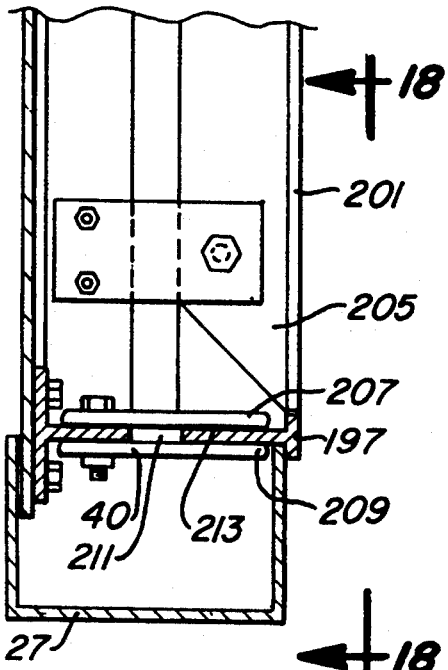
FIG. 17 is a sectional view taken through section lines 17—17 of FIG. 3.
Figure 18:
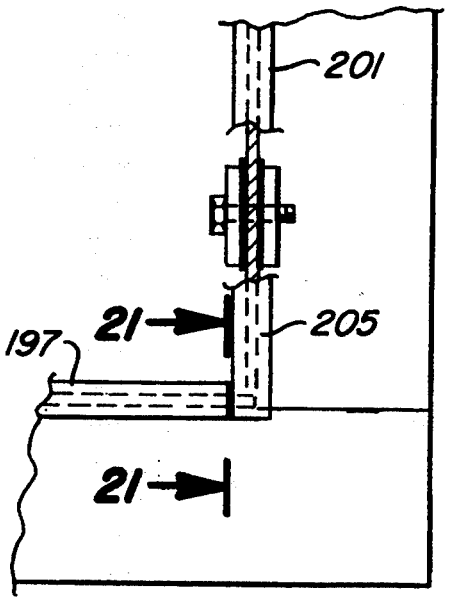
FIG. 18 is a front view taken at lines 18—18 of FIG. 17.
Figure 19:
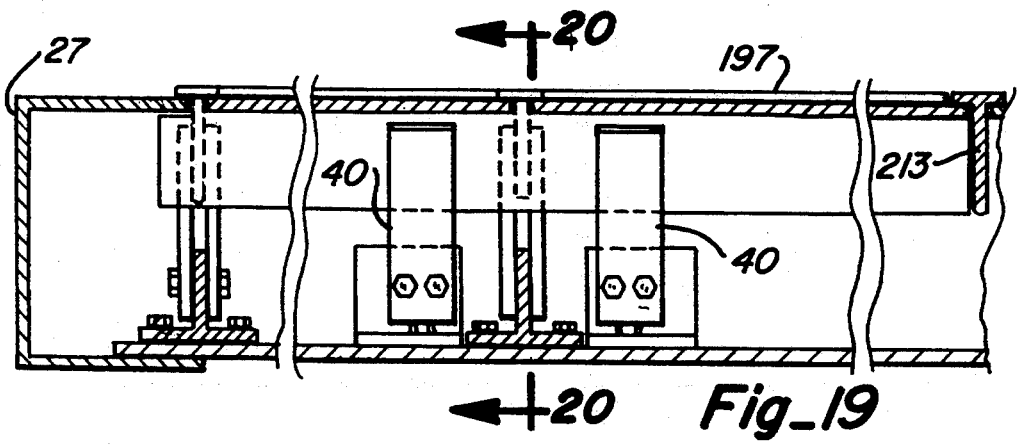
FIG. 19 is a sectional view taken through section lines section 19—19 of FIG. 3.
Figure 20:
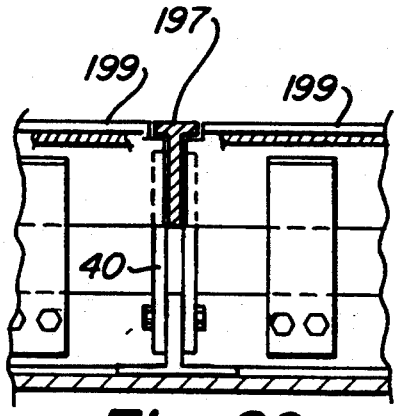
FIG. 20 is a sectional view taken through section lines 20—20 of FIG. 19.
Figure 21:
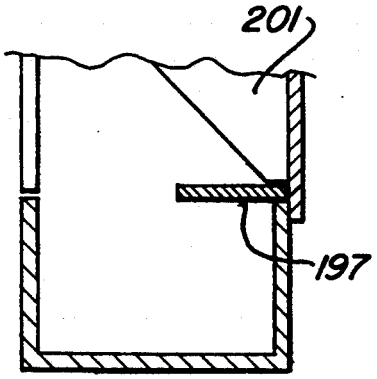
FIG. 21 is a sectional view taken through section lines 21—21 of FIG. 18.
Figure 22:
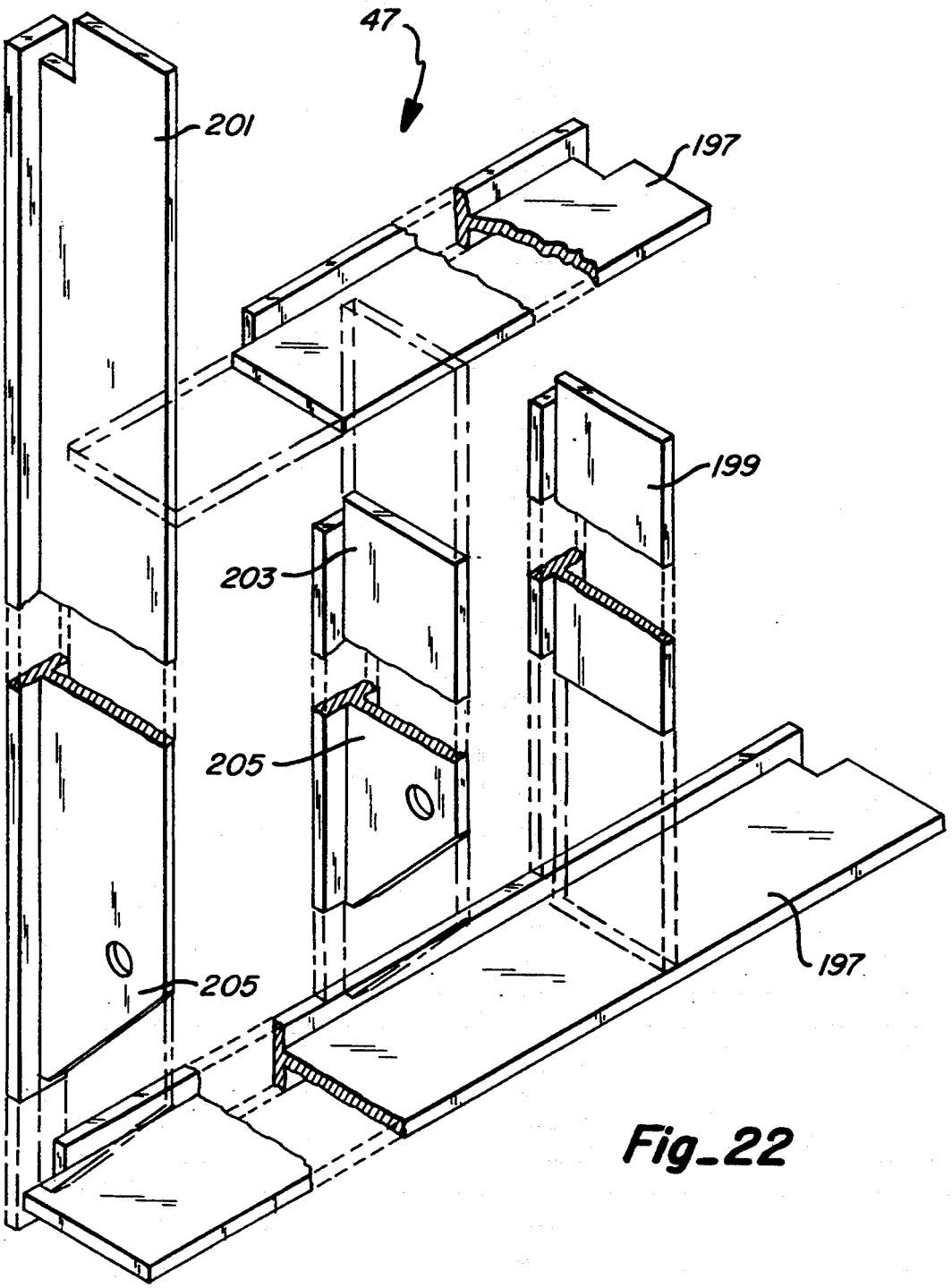
FIG. 22 is an exploded partial perspective view of the interlocking trim pieces for securement of module cover plates with the mounting structure of the device.

FIGS. 14 through 16 illustrate control interface 35. Currency (defined herein to mean any means of monetary exchange including, without limitation, coins, bills, credit cards, tokens, or the like) receivers 175, including for example a quarter acceptor, bill validator, credit card scanner and the like, and cash collection box are provided, with manager and customer computer interface being facilitated by CRT 177 and keypad 179. For maintenance, these elements are accessed by door 181 hingedly connected with plate 183. Interface 35 inhabits two modular bays and is secured by two locks 185 and 187 engageable with plate 188.

Door 181, when open, provides the only external access to the device to remove cash, down load history data from the computer, and to make repairs as necessary. Also the door provides access to the bolts which hold the keystone frame trim pieces in place as discussed herein after. CRT 177 and the keypad 179 are mounted at an angle and are at the point of transition between the outward extending bottom of the door and the inward extending top.

Door 181 has three graphics surfaces, one in top (recessed) front surface 189 (for display of customer instructions, prices, a picture intended to graphically show how to insert paper into the paper path of an open window, or the like), another in panel 191 containing the CRT and keypad to display information to cross reference the keys with the text displayed on the CRT, and the last in lower front surface 193 which contains the quarter slot, bill validator access and the like.

Paper sizer 194 (see FIG. 1) for use by the customer could be provided, for example on the lower front surface 193 of door 181, comprised of a long metal bar spaced from the front door surface forming a gap equal to the thickness of a window paper path. The customer is instructed to slide their paper through the gap before inserting currency into the machine to assure fit. In addition, hash marks or lines on the surface of the lower door spaced at distances which represent the lengths and widths of 3 standard window paper sizes could be provided.

Trim pieces 47 are described in FIGS. 17 through 22, the function of which are to hold cover plates 65 and graphic cover panels 43 and 45 in place and visually cover the gaps between module cases 55 and the cases and edges of frame 27. The trim has been designed to be installed and removed from the front of the device while at the same time being tamper proof.

This is done with a series of long and short interlocking and overlapping trim pieces which are held in place by catching under the edge of the frame side channels or under adjacent trim pieces. Four basic trim pieces 197, 199, 201 and 203 are provided and are installed in an appropriate order until there are only ends 205 of pieces 201 and 203 (the keystones) which are left to be anchored (by a screw, bolt or the like) within frame 27. Ends 205 are then only accessible through door 181.

All trim pieces are slidably received by stop pairs 40, the pairs each being formed of two individual pieces 207 and 209, thus forming a tightly gripping aperture 211 therebetween for receipt of tee legs 213 of the trim pieces.

Figure 23:
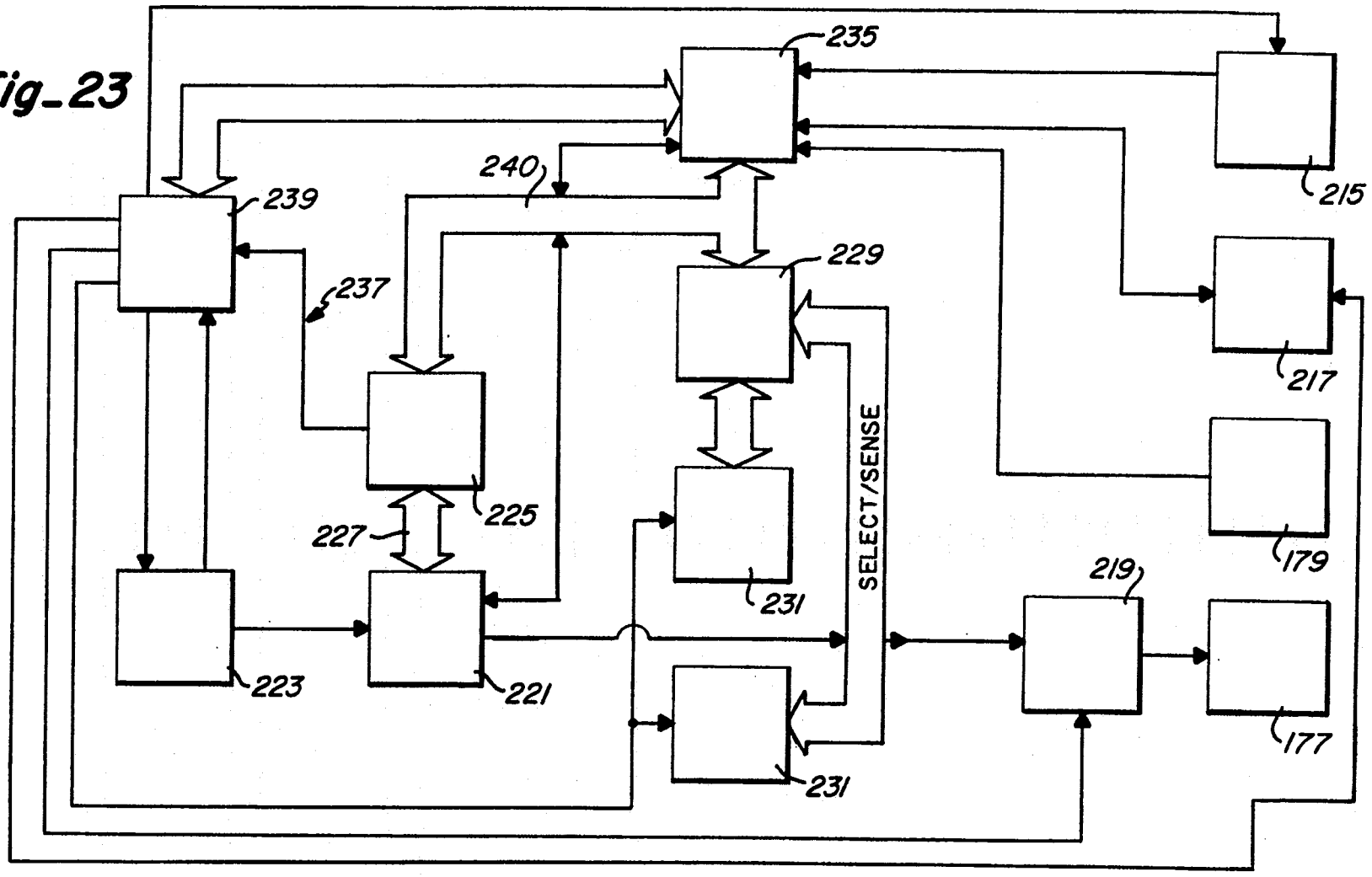
FIG. 23 is a block diagram illustrating the operational electronics of the device.

Having reference to FIG. 23, the electronic configuration of the device is shown for opening of individual assemblies 57, tracking of and locking out of display areas which are in use, tracking of currency received by the device and when a customer message was posted, how many days were paid for, when the message is to be removed, storing history data to disk and the like.

Many of the major electronic components are off the shelf components including quarter acceptor 215, bill validator (accepting $1 and $5 bills) 217, keypad keys (16 keys, 0–9 plus six keys for other uses) 179, cathode ray tube ( for example a 7" diagonal monochrome CRT) 177, CRT video board 219, computer 221 (for example an IBM AT compatible, 12 Mhz. computer with 1 Meg. memory, 3.5" floppy drive, two serial ports, and 1 expansion slot), and power supply 223.

Application specific components include bus interface board 225 coupled into the computer expansion slot and tapped into computer 221 bus I/O system 227 (and providing the 5 volt power to digital I/O board 229 and interface board 235 from computer power supply 223). Digital I/O board 229 is connected between bus interface board 225 and window connector board 231 and directs output signals from computer 221 to the appropriate transistor on window connector board 231 to open a selected assembly 57 as well as directing input signals from switch 121 to computer 221. One digital I/O board controls 2 window connector boards ( controlling 32 individual assemblies 57) and has a connector with which to attach another identical digital I/O board which can handle another 2 window connector boards. Chaining of digital I/O boards and related window connector boards can be continued depending on the number of assemblies 57 to be controlled.

Window connector boards 231 have 16 plugs each for connection of 16 individual latch release assemblies 61, and have 16 transistors each by which solenoids 151 are activated. Boards 231 also direct signals indicative of latch switch 121 condition (on or off) to digital I/O board 229 and hence to the computer.

Interface board 235 contains a circuit to interface and decode the keypad and quarter accepter inputs and route them to bus interface board 225, and a circuit which translates the output from the bill validator so it can be read at a computer serial port and vice versa. Watch dog circuit 237 monitors computer bus 227 to make sure the computer's CPU is functioning. If there is no bus activity for a period of time this circuit assumes that the CPU is no longer functioning, turning off and then on the power to the computer thus forcing a reboot. This circuit is activated by software after the computer is booted to prevent a continuous reboot loop if the forced reboot does not correct the problem.

Power supply 239 provides 24 VDC to solenoids 151, power to quarter acceptor 215 (24 VAC), and powers watch dog circuit 237. CRT 177 and video board 219 are powered by tapping into the computer's power supply 223 (12 VDC) and bill validator 217 uses standard 110 VAC.

As a general rule the circuit boards are mounted on an electronics plate (similar to the back plate of a module) which is then mounted in one or more of the modular bays, for example in the top tier of bays. One current implementation has been designed to electronically handle up to 128 different display areas (4 digital I/O boards connected to 8 window connecter boards).

Bus interface board 225 taps into bus 227 and accesses a series of consecutive available bus addresses (provided as part of any standard AT or compatible computer) and connects these addresses to digital I/O board 229. Each bus address contains one byte (8 bits) of I/O capability. Each one byte bus addresss controls 8 assemblies 61/57 (one per bit). The output side of principle bus 240 controls solenoids 151. In a similar way the input side of bus 240 reports the state of switch 121 (on or off). Thus a specific assembly 61/57 may be controlled by the software by knowing its unique bus addresss and bit.

Figure 24A:
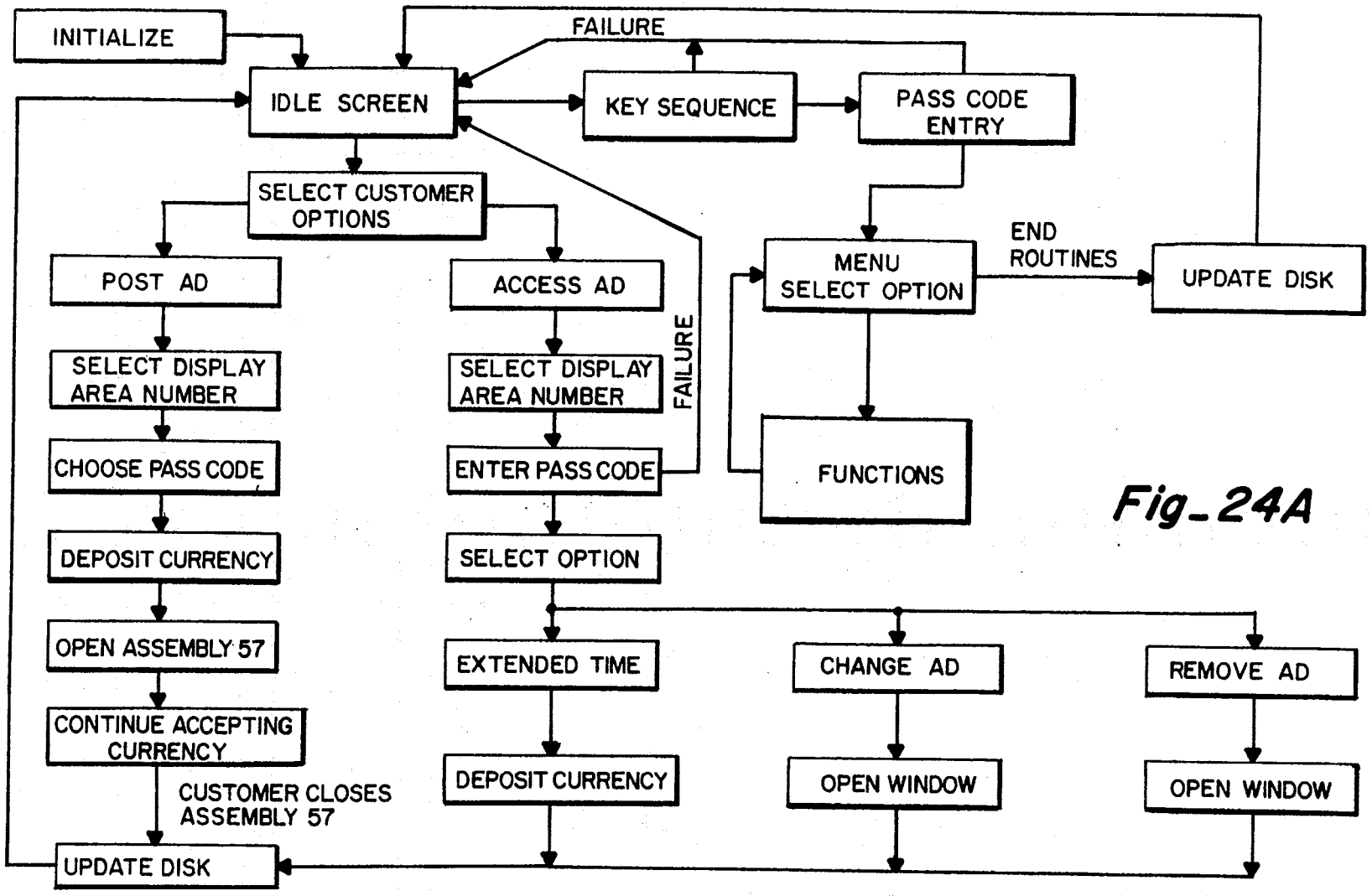
FIGS. 24A, 24B, and 24C are software flowcharts.

In one current embodiment of the software (see FIGS. 24A, 24B and 24C), when the computer is booted, either because power was applied or as a result of a warm boot, MS/DOS loads first and then calls the operating system and interpreter which in turn calls the custom software which loads appropriate data from disk and sets itself to the idle terminal mode making it ready for customer use. No human intervention is needed during the initialization process.

All data which is changed, whether by a customer or service personnel is immediately written to disk to prevent its loss should the 110 VAC power fail, preferably after the user has completed the current session at the machine and the software is returning to the idle terminal mode. Likewise, all data possible (within memory constraints) will be kept in memory (duplicated on disk) to avoid all possible reads to disk which would slow down the user. Also to prevent data loss in the event of a power failure, all disk data files are kept closed except when they are being written to or read from to defeat MS/DOS's write cashing features.

Figures 24B, 24C:
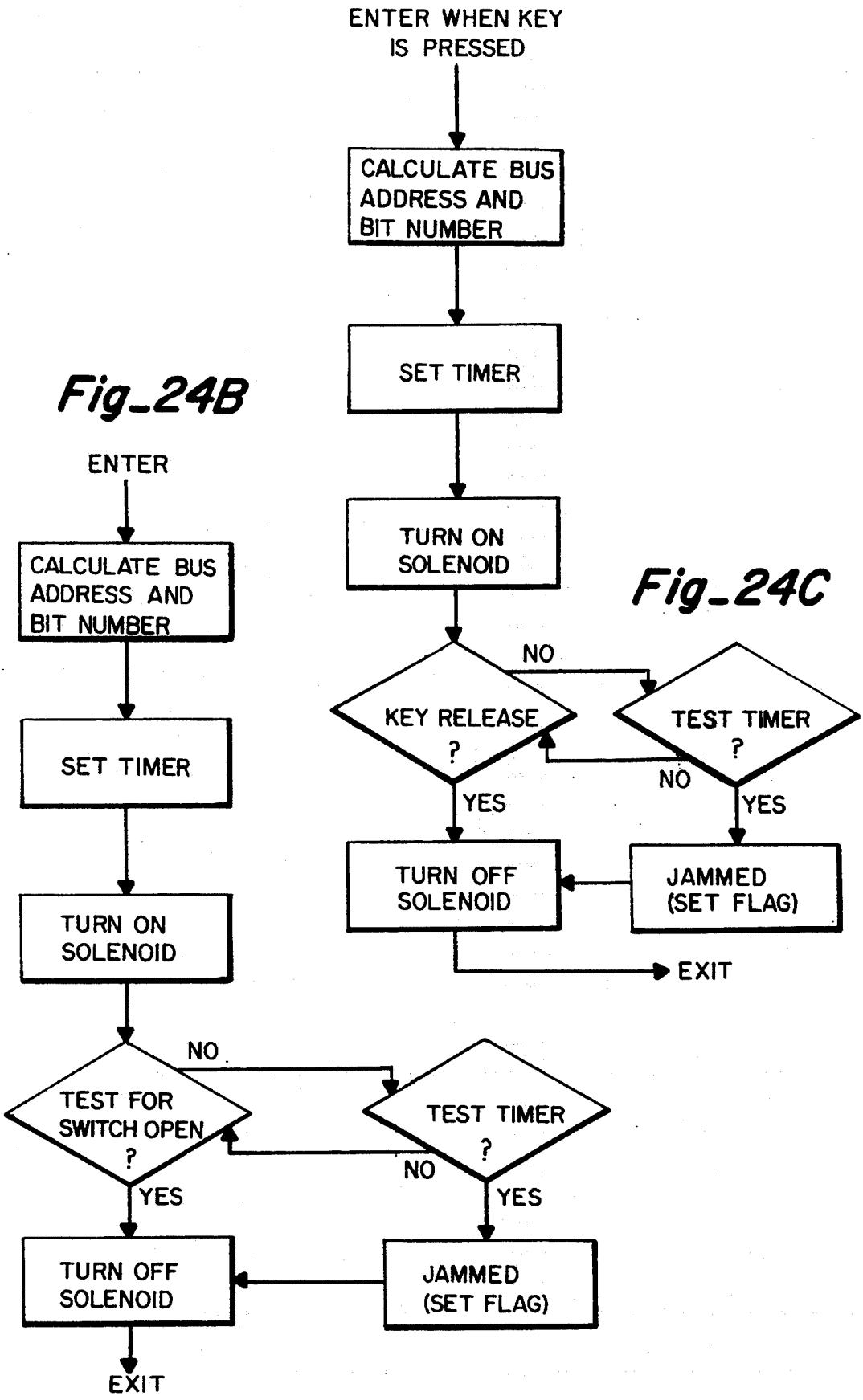

All program input statements and program locations where a user could accidently or intentionally walk away and leave the machine unattended will time out and return the software to the idle terminal mode after a certain period of time appropriate to the specific function being performed by the software at the time. Some of the display area opening software routines are written to time out to keep from burning out a solenoid or transistor and report a problem condition back to the software for appropriate error handling (FIGS. 24B and 24C).

For example, to perform the user assembly 57 opening function, the software will order solenoid activation and go into a loop which looks for switch 121 to open and checks the time for a specific time out period (several seconds). If switch 121 opens before the time out period has been exceeded the software turns off solenoid 151 and proceeds to the next step (a no error condition). If the time out period is exceeded before switch 121 opens the software turns off the solenoid and proceeds to an error routine under the assumption that assembly 61/57 is jammed and did not open. For service personnel opening of assembly 57 to the fully open position, a similar process is undertaken with the exception that, rather than testing switch 21 position, a test for a key release within the set period is performed.

Software tracks all data relating to each display area assembly based on each individual assemblies logical number. This logical number is based on the physical location of the assembly in the device by bay row number, bay column number, and module display area number. For example the logical number 245 would represent the window in the 2nd modular bay row, the 4th modular bay column, and the 5th display area (in a six display area module). All computer data recording and storage, including history reporting, is based on this logical number format.

Two other numbers are linked by the software to each logical window number. The linking will take place when a unit is initially configured or when it is reconfigured (i.e., when modules are changed) and is accomplished using software utility programs accessible only by authorized service personnel. After using the software to configure the devices number of rows, columns, and display areas to define the logical window numbers, each display areas tag number and board number must be defined and entered into the computer using appropriate software routines.

The tag number is the number which is displayed in the display area windows and used by the customer and the service person to select a display area. A display area with a logical number of 245 may be assigned a tag number of 17. Thus, if a user wants to select the 5th display area in the 2nd modular bay row and the 4th modular bay column, number 17 will be keyed in.

The board number tells the software how the individual display area is wired. If the latch release assembly in logical window number 245 is connected to the 2nd window connector board in the 9th plug position (of 16) it must be assigned a board number of 209. The software uses this number to calculate (by formula) the bus address and bit number to use for I/O control of a particular release assembly 61.

Software errors which have not been specifically handled by the custom software will be trapped by a utility error handling routine and written to a history file on disk.

All human input to the software will come from keypad 179. When not in use the software will be in the idle terminal mode. In this mode the software may periodically move a message like "To Activate Press The "x" Key" around the CRT to prevent CRT burn in. In addition, the idle terminal mode provides a transparent polling function to check for certain conditions and, if they are met, execute certain program routines such as time correction routines or automatic reboot routines to refresh computer memory.

From the idle terminal mode there are two major program branches, the customer routines and a multiple key, manager's access sequence, transparent to all other users, for transferring program control to a pass code entry routine for use by service personnel. The access sequence will require entering the correct key strokes in the correct order within a few seconds. If a mistake is made or the time requirement is not met the software returns to the idle terminal mode.

In the customer software routines, after pressing the appropriate key to activate the keypad/CRT, the customer will be given two options: post an ad or access an already posted ad. In posting an ad the customer will select an available display area (by window, or tag, number based on a CRT displayed picture of device configuration, display area numbers and availability) guided by the available flags displayed in available windows. The software will confirm that the selected display area is in fact available and will not allow selection of one which is in use.

The customer will be asked to enter a numeric pass code of their choice (for example, 4 digits) for later use if they wish to access their display area during the display time purchased. The customer will then be instructed to insert currency, cash (quarters or $1 or $5 bills) or credit card. As cash is inserted, or in the case of credit card as time is selected, the software will display and update the amount of time paid for and the scheduled removal date based on the current price per day for the display area size selected.

When the customer has inserted or entered enough Currency to pay for the time they wish to display their ad, they will press a key indicating that they are finished. This will cause the software to activate the system to open the selected assembly 57 and thus access 31. Alternatively, assembly 57 may be activated merely by insertion or entry of a minimum currency requirement established in software, the customer continuing deposit until their desired display time is paid for. The customer then inserts the ad and pushes assembly 57 closed.

The software then performs a number of updates including marking the window "in use", calculating its ad removal date and time, and logging the date, time, display area ID, amount of sale, and other information to history files on disk. In addition, the software will add the amount of the sale to the absolute and incremental currency counters which keep track of all currency generated by the device from its installation dated (absolute) and since the last time cash was removed by service personnel (incremental).

If the customer selects their display area number and enters their pass code (which they selected when initially posting their ad) access to their display area will be allowed. If the pass code entered is not correct access is denied. The customer may attempt to re-enter the pass code several times (up to 5) before the software will lock out the keypad for several minutes (to make continuous pass code guessing time consuming and inconvenient).

Upon successful entry of their pass code the customer will be able to choose between insertion or entry of additional currency to extend their time, or opening of their display area access to change or remove their ad (with reset to available status).

For manager software routines, after successfully entering the access sequence, service personnel will be asked to log on by entering their unique individual pass code (for example, 5 or 6 digits). Repeated pass code entry errors will cause the software to lock out the keypad for several minutes before returning to the idle terminal mode to make it inconvenient and time consuming to guess at pass codes. Upon successful entry of the pass code a menu will be presented for selection (by menu number) of the specific function to be performed.

For security and control purposes the specific menu selections displayed and available for use will be dependent on the security level assigned to the pass code used. All users are assigned a security level at the time their pass code is assigned. This level is tied to the pass code. A user assigned a low security level will have access to only a few menu selections. A higher security level will allow access to more selections.

After functions performed by various menu selections are executed (and as appropriate to the function) the pass code used to log on and allow performance of the functions along with date and time information will be written to disk as history data to provide management control information.

Such menu driven functions include utility functions such as unit configuration (i.e., defining modular bay rows, columns, and number of display areas per module), linking tag and board numbers to logical window numbers, setting date and time, pass code maintenance (addition and deletion of individual codes and assignment of security levels), menu maintenance such as the addition or deletion of software functions to the menu for a given security level, price change maintenance, warm boot of the computer, and exit from the operational program and interpreter to the DOS prompt.

Various service functions performed by maintenance personnel utilizing the menu driven software include auto ad removal and display area access reset wherein automatic sequential opening and reset to available status of all display area accesses whose time has expired is carried out (with the service person removing the ads and closing the windows), manual ad removal and display area reset to open and reset only one selected display area, automatic opening of all display area accesses without reset, and manual display area opening without reset (opens one selected display area access to customer open position or full open position, as selected).

A move ad function allows personnel to open a selected in use access and a selected available access and switches the related display area's file data. The service person then moves the ad and closes the access. A manual ad placement function permits opening of a selected available display area access for ad insertion with entry of removal date and time but without currency deposit. The manual time extension function allows selection of an in use display area and entry of a new removal date and time, again without currency deposit.

The cash removal procedure displays, writes to a history file, and resets to zero the incremental cash counter amounts (the amount of cash by currency type which should be in the machine since the last time cash was removed). The service person reconciles the incremental cash counter amounts with the actual cash removed. Machine history data from the resident floppy disk may be copied to a disk to be brought to company headquarters for processing. Exchange of the current floppy disk with a new one while maintaining all the device's data intact to either replace an aging disk with a new one or to upgrade the custom software can be performed under software control.

Inquiry functions, such as display of cash counter amounts, of important dates and times such as the last cash removal, last history down load, last auto ad removal, or the like, of in use display area data such as the date/time an ad was placed, amount paid, customer pass code, date/time of scheduled removal, or the like, or of quantity of ads placed may be performed under menu driven software control, as can diagnostic functions such as testing of the quarter accepter, bill validator and display area assemblies operation.

What is claimed is:

1. A user operated, currency activated display device for displaying material selected by a user, said device comprising:

a display area having a normally closed and secured user access for selective receipt thereat of the material for display; and control means operatively associated with said display area user access for, responsive to deposit of an amount of currency by the user corresponding to a user selected time period for display, opening said user access of said display area for placement by the user of the material therein and for preventing reopening of said user access thereafter by different users at least for said time period.

2. The device of claim 1 wherein the material is printed matter, and wherein said access has a slot defined thereat for receiving and holding the material.

3. The device of claim 1 wherein said access is pivotably connected at said display area by a substantially vertically oriented hinge.

4. The device of claim 1 wherein said display area has a default display access behind said user access for receipt thereat of material for display.

5. The device of claim 1 wherein said display area is located in a module, said device further comprising a plurality of said modules, mounting means for mounting said modules thereon and for mounting said device at a location, and means for allowing maintenance access to the device so that all maintenance access to the device is accomplished from the front thereof.

6. The device of claim 5 wherein said control means includes centralized currency receiving means and selection means for user selection of a desired display area.

7. The device of claim 5 wherein at least some of said modules have a plurality of display areas located thereat, each having its own user access.

8. The device of claim 1 further comprising display material sizing means on said device for providing user assurance of display material size compatibility in said display area in advance of placement by the user of the display material in said display area.

9. A currency activated display device for operation by any of a plurality of users to display material selected by a user activating said device, said device comprising:

a plurality of display units each having a normally closed and secured user access for receipt thereat of the material for display;

means for holding said display units; and centralized control means operatively associated with said user access of each of said display units for, responsive to deposit of currency corresponding to user selected display time and selection of one of said display units by the user, opening said user access of said selected one of said display units for placement by the user of the material therein and for monitoring said selected display time and indicating, responsive to a request signal, whether said selected display time has elapsed.

10. The device of claim 9 wherein each of said display units include a housing, a latch connected with said access and operatively connected with said control means, and a cover plate securable on the housing, each of said units being mounted in said means for holding said units.

11. The device of claim 10 wherein said latch includes first and second catches corresponding to the normally closed/secured position and a first partly opened position, respectively, of said access, said units each including switching means connected with said housing and with said control means for selectively allowing opening of said access to said second catch by the user and to a completely opened position free of said catches by an individual maintaining said device.

12. The device of claim 10 wherein said means for holding said display units includes positioning members and wherein said cover plates of said units are secured on said housing by interlocking trim units received by said positioning members.

13. The device of claim 12 wherein said interlocking trim members include a keystone trim member removal of which allows removal of all other trim members and access for removal of which is limited to device maintenance personnel.

14. The device of claim 9 wherein at least some of said units include a default display access behind said user access for receipt thereat of material for display.

15. The device of claim 14 wherein each of said accesses is pivotably connected in said display units, said user access and said default display access being connected at opposite sides of each of said units.

16. The device of claim 14 wherein the material is printed matter, and wherein all of said accesses have a slot defined thereat for receiving and holding the material.

17. The device of claim 9 wherein said control means includes a user interface for centralized receipt of the currency, user instruction, and centralized user selection of a desired display unit.

18. The device of claim 17 wherein said user interface includes an electronic visual display and electronic means for user input.

19. A method for displaying user selected material in a display area of a currency activated device, said method comprising the steps of:

deposit by the user of an amount of currency in the device corresponding to a user selected time period for display;

opening by the device of a normally closed and secured display area access after the currency is deposited;

placement by the user of the material into the display area;

closing of said access whereupon said access is again secured; and prevention by the device of reopening of said access by different users at least for said time period after placement of material by the user into the display area.

20. The method of claim 19 further comprising the steps of user input into the device of indicia of a selected duration for material display and storage by the device of the duration selected.

21. The method of claim 20 wherein the device has a plurality of display areas each having a separate access, the method further comprising the step of opening by the device, responsive to a request signal input by an individual maintaining the device, of all of those accesses wherein the selected material display duration has elapsed.

22. The method of claim 19 wherein the device has a plurality of display areas each having a separate access, the method further comprising the steps of user input into the device of indicia indicative of a selected one of said display areas and opening of said access to said selected one of said display areas responsive thereto only if said selected one is not in use.

23. The method of claim 22 further comprising the step of simulation of display areas layout by the device at an electronic display unit.

24. The method of claim 19 further comprising the step of placement of display material in a default display area located in said device behind said display area access.

25. The method of claim 19 further comprising the step of maintenance by the device of at least one of display area use history data, display time history data, currency exchange history data and device upkeep history data.

26. The method of claim 19 further comprising the step of selection by the user of a pass code for allowing, during said selected period of time by inputting said pass code into the device, at least one of user reentry into the display area, user extension of said selected period of time and user inquiry into time remaining in said selected period of time.

27. The method of claim 19 wherein the device has a controller, the method further comprising loading a marketing program in said device for use by said controller.

* * * * *